US010251223B2

(12) United States Patent
Linton

(10) Patent No.: US 10,251,223 B2
(45) Date of Patent: Apr. 2, 2019

(54) APPARATUS FOR PROVIDING CUSTOMIZABLE HEAT ZONES IN AN OVEN

(71) Applicant: Illinois Tool Works Inc., Glenview, IL (US)

(72) Inventor: Joshua M. Linton, Chicago, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 537 days.

(21) Appl. No.: 14/717,100

(22) Filed: May 20, 2015

(65) Prior Publication Data

US 2016/0345391 A1 Nov. 24, 2016

(51) Int. Cl.
*H05B 6/64* (2006.01)
*H05B 6/70* (2006.01)

(52) U.S. Cl.
CPC ..... *H05B 6/6473* (2013.01); *H05B 6/6408* (2013.01); *H05B 6/6411* (2013.01); *H05B 6/6488* (2013.01); *H05B 6/6491* (2013.01); *H05B 6/6494* (2013.01); *H05B 6/70* (2013.01)

(58) Field of Classification Search
CPC .. H05B 6/6408; H05B 6/6411; H05B 6/6473; H05B 6/6488; H05B 6/6491; H05B 6/6494; H05B 6/70; F24C 15/16
See application file for complete search history.

(56) References Cited

U.S. PATENT DOCUMENTS 3,806,689 A * 4/1974 Kegereis ..... H05B 6/6402 219/697
4,904,836 A * 2/1990 Turpin ..... B65D 81/3446 219/730
4,970,358 A 11/1990 Brandberg et al.
5,079,397 A * 1/1992 Keefer ..... B65D 81/3446 219/730
5,368,199 A * 11/1994 Haas ..... B05C 17/00546 219/679
5,391,864 A * 2/1995 Bodor ..... A21D 8/06 219/730
5,519,196 A * 5/1996 Xu ..... H05B 6/6494 219/730
6,133,560 A * 10/2000 Zeng ..... B65D 81/3446 219/730
6,251,451 B1 * 6/2001 Zeng ..... B65D 81/3453 219/728

(Continued)

OTHER PUBLICATIONS

International Search Report and Written Opinion of the International Searching Authority for corresponding International Application No. PCT/US2016/033027 dated Oct. 10, 2016.

*Primary Examiner* — Dana Ross
*Assistant Examiner* — Joe E Mills, Jr.
(74) *Attorney, Agent, or Firm* — Burr Forman McNair

(57) ABSTRACT

An oven may include a cooking chamber configured to receive a food product, a radio frequency (RF) heating system configured to provide RF energy into the cooking chamber; and an energy conversion assembly provided as a cooking surface of the oven. The energy conversion assembly may be configured to convert at least some of the RF energy into thermal energy for heating the food product, while at least some other portion of the RF energy is directly applied to the food product to heat the food product.

20 Claims, 9 Drawing Sheets

(56) References Cited

U.S. PATENT DOCUMENTS 7,868,274 B2 * 1/2011 Bohme ..... B65D 81/3446 219/725
8,247,750 B2 * 8/2012 Lai ..... A21B 2/00 219/728
8,440,275 B2 * 5/2013 Cole ..... B65D 65/14 428/34.1
8,492,686 B2 * 7/2013 Bilchinsky ..... H05B 6/688 118/723 E
8,598,500 B2 * 12/2013 Blankenbeckler ..... H05B 6/704 219/728
8,648,284 B2 * 2/2014 Quantrille ..... C04B 35/117 219/678
8,835,822 B2 * 9/2014 Blankenbeckler ..... H05B 6/74 219/728
8,847,132 B2 * 9/2014 Russell ..... B65D 81/3446 219/730
9,035,225 B1 * 5/2015 Zeng ..... H05B 6/6494 219/728
9,073,689 B2 * 7/2015 Files ..... B65D 81/3446
9,215,756 B2 * 12/2015 Bilchinsky ..... H05B 6/705
2003/0226840 A1 * 12/2003 Dalton ..... B01D 53/32 219/634
2004/0144773 A1 * 7/2004 Kim ..... H05B 6/129 219/601
2005/0173425 A1 * 8/2005 Wnek ..... B32B 7/02 219/730
2006/0213906 A1 * 9/2006 Buchala ..... B65D 81/3446 219/730
2007/0023426 A1 * 2/2007 Russell ..... B65D 81/3446 219/730
2007/0062936 A1 * 3/2007 Young ..... B65D 81/3446 219/730
2007/0215611 A1 * 9/2007 O'Hagan ..... B29C 51/10 219/730
2007/0251943 A1 * 11/2007 Wnek ..... B65D 81/3446 219/730
2008/0081710 A1 * 4/2008 Chen ..... A63B 37/0023 473/373
2009/0145420 A1 * 6/2009 Whitis ..... A47J 36/022 126/246
2009/0302032 A1 * 12/2009 Middleton ..... H05B 6/6494 219/730
2010/0038359 A1 * 2/2010 Laubhan ..... B65D 5/5455 219/730
2010/0155391 A1 * 6/2010 Koschberg ..... B64D 11/04 219/672
2010/0264135 A1 * 10/2010 Cole ..... H05B 6/6494 219/730
2010/0264356 A1 * 10/2010 Cook ..... B29C 35/0805 252/62.54
2010/0270294 A1 * 10/2010 Lafferty ..... H05B 6/6494 219/730
2010/0288756 A1 * 11/2010 Uchiyama ..... H05B 6/6408 219/756
2011/0108548 A1 * 5/2011 Nobue ..... H05B 6/6402 219/702
2011/0198344 A1 * 8/2011 Uchiyama ..... H05B 6/6408 219/680
2011/0240635 A1 * 10/2011 Lafferty ..... B32B 27/08 219/759
2014/0061189 A1 * 3/2014 Lim ..... H05B 6/6408 219/681
2014/0263296 A1 * 9/2014 Heineck ..... H05B 6/70 219/756
2016/0295645 A1 * 10/2016 Mazzon ..... F24C 15/16

* cited by examiner

APPARATUS FOR PROVIDING CUSTOMIZABLE HEAT ZONES IN AN OVEN

TECHNICAL FIELD

Example embodiments generally relate to cooking technology and, more particularly, relate to an apparatus that enables the provision of customizable heat zones using a single energy source.

BACKGROUND

Combination ovens that are capable of cooking using more than one heating source (e.g., convection, steam, microwave, etc.) have been in use for decades. Each heating source comes with its own distinct set of characteristics. Thus, a combination oven can typically leverage the advantages of each different heating source to attempt to provide a cooking process that is improved in terms of time and/or quality.

In some cases, microwave cooking may be faster than convection or other types of cooking Thus, microwave cooking may be employed to speed up the cooking process. However, a microwave typically cannot be used to cook some foods and also cannot brown foods. Given that browning may add certain desirable characteristics in relation to taste and appearance, it may be necessary to employ another cooking method in addition to microwave cooking in order to achieve browning. In some cases, the application of heat for purposes of browning may involve the use of heated airflow provided within the oven cavity to deliver heat to a surface of the food product.

However, by employing a combination of microwave and convection cooking, it can be appreciated that two separate heat sources must be provided. One such heat source handles microwave energy application, and the other heat source handles convection cooking application. The provision of two separate cooking sources can increase the complication associated with management of the application of heat, and can also increase the cost of the corresponding combination oven. Thus, it may be desirable to provide further improvements to the ability of an operator to achieve a superior cooking result that is at least potentially achievable without requiring the cost and complication of providing two separate heat sources.

BRIEF SUMMARY OF SOME EXAMPLES

Some example embodiments may provide an oven, or an apparatus for use in an oven, that employs a single heat energy application source, but is capable of providing heat energy via at least two different methods via the single heat energy application source. For example, application of radio frequency (RF) energy (or other frequency or electromagnetic energy) may be propagated within a cooking chamber, and an apparatus of an example embodiment (e.g., an energy conversion assembly) may include a carrier matrix having different concentrations of ferromagnetic material may also be provided within the cooking chamber (e.g., as a bottom surface of the cooking chamber or as a rack (removable or permanently placed) within the cooking chamber). The energy conversion assembly may convert the RF energy applied into thermal energy in the form of heat at the surface thereof to provide convective/conductive heating along with the RF energy heating, all from a single heat energy application source. Thus, one RF energy source can power both RF and at least one other cooking method. However, it may also be possible to employ other heat application sources as well (e.g., provision of heated airflow to at least partially cook food disposed in the cooking chamber).

In an example embodiment, an oven is provided. The oven may include a cooking chamber configured to receive a food product, a radio frequency (RF) heating system configured to provide RF energy into the cooking chamber; and an energy conversion assembly provided as a cooking surface of the oven. The energy conversion assembly may be configured to convert at least some of the RF energy into thermal energy for heating the food product, while at least some other portion of the RF energy is directly applied to the food product to heat the food product.

In another example embodiment, an energy conversion assembly is provided. The energy conversion assembly may be useable in an oven. The energy conversion assembly may include a base matrix comprising formed substantially to have a plate shape, and ferromagnetic particulate material dispersed in the base matrix. The ferromagnetic particulate material may absorb RF energy to transform the RF energy into thermal energy. A concentration of the ferromagnetic particulate material may be changed in corresponding different locations to define at least a first heat zone having a first concentration of the ferromagnetic particulate material therein, and a second heat zone having a second concentration of the ferromagnetic particulate material therein. The first and second concentrations may be different from each other.

In still another example embodiment, a method of cooking a food product in an oven having a surface therein that includes an energy conversion assembly is provided. The method may include providing a cooking chamber configured to receive the food product, providing RF energy into the cooking chamber at a first frequency and a second frequency, and heating the food product directly via the first frequency and indirectly via the second frequency responsive to thermal heat generation by the energy conversion assembly. The energy conversion assembly may include a base matrix and ferromagnetic particulate material dispersed in the base matrix. The ferromagnetic particulate material may absorb RF energy to transform the RF energy into thermal energy.

Some example embodiments may improve the cooking performance and/or improve the operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
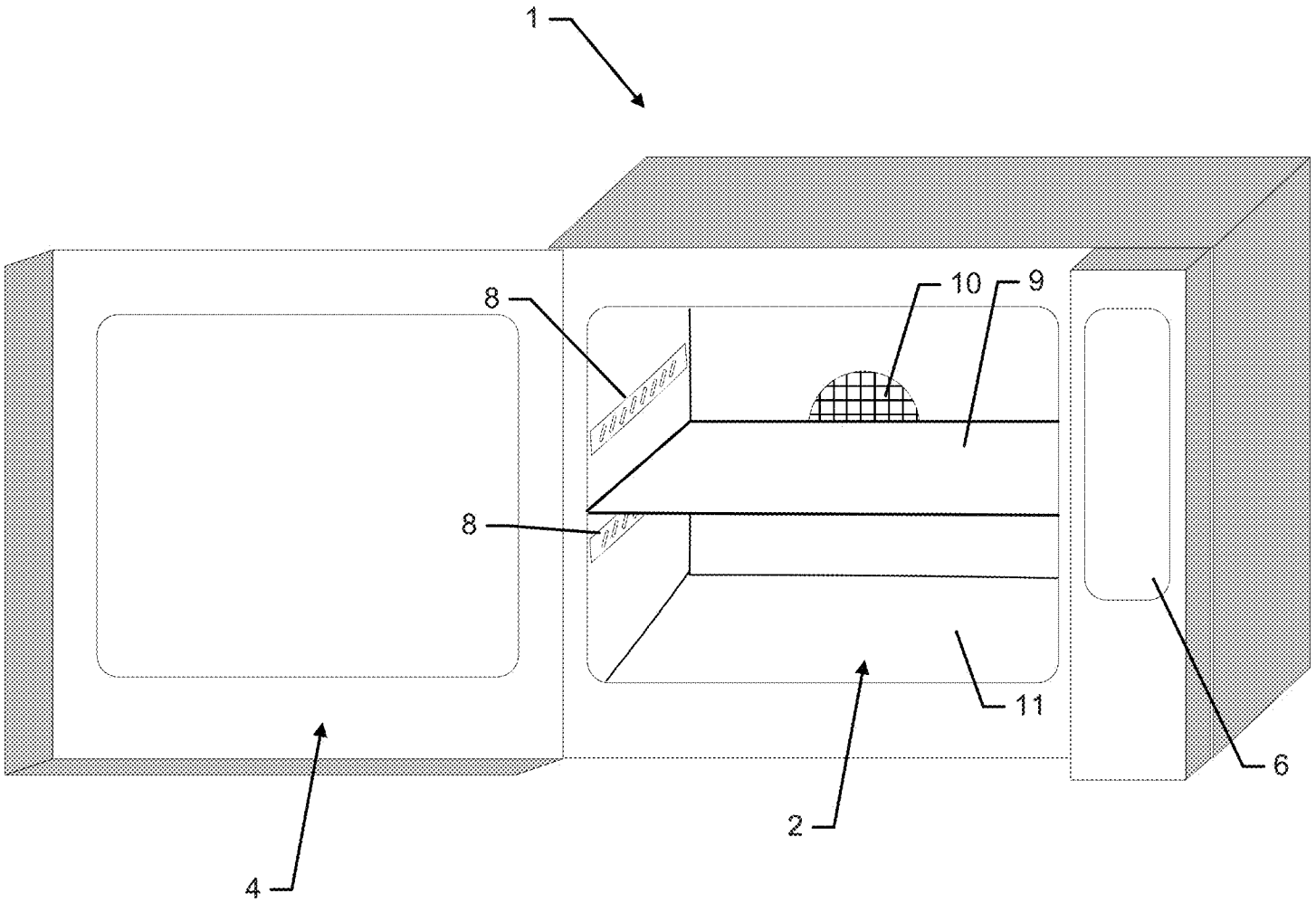
FIG. 1 illustrates a perspective view of an oven capable of employing an energy conversion assembly according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other. Furthermore, as used herein the term "browning" should be understood to refer to the Maillard reaction or other desirable food coloration reactions whereby the food product is turned brown via enzymatic or non-enzymatic processes.

Some example embodiments may improve the cooking performance of an oven and/or may improve the operator experience of individuals employing an example embodiment. In this regard, an energy conversion assembly may be provided to include a carrier matrix having different concentrations of ferromagnetic material to designate different portions of the energy conversion assembly to provide different heat generation and/or transfer properties. As mentioned above, the energy conversion assembly may also be enabled to allow a single RF energy source to be used to generate both RF heating and convention/conduction heating. As such, some embodiments may also employ a single heat energy source to power two different cooking methods. Thus, the same RF energy source can cook via two methods at the same time. Moreover, one such method may be capable of providing browning. Example embodiments may therefore assist with the provision of a properly browned, but also well finished product.

FIG. 1 illustrates a perspective view of an oven 1 according to an example embodiment. As shown in FIG. 1, the oven 1 may include a cooking chamber 2 into which a food product may be placed for the application of heat by any of at least two energy sources that may be employed by the oven 1. The oven 1 may include a door 4 and an interface panel 6, which may sit proximate to the door 4 when the door 4 is closed. In an example embodiment, the interface panel 6 may include a touch screen display capable of providing visual indications to an operator and further capable of receiving touch inputs from the operator. However, other interface mechanisms are also possible. The interface panel 6 may be the mechanism by which instructions are provided by the operator, and the mechanism by which feedback is provided to the operator regarding cooking process status, options and/or the like.

In some embodiments, the oven 1 may include one or more rack (or pan) supports or guide slots in order to facilitate the insertion of one or more racks 9 or pans holding food product that is to be cooked. Although no forced air is required in some embodiments, in others, one or more jet plates 8 may be positioned proximate to the rack supports or corresponding racks 9 to enable air to be forced over a surface of food product placed in a pan or rack 9 associated with the corresponding rack supports via air delivery orifices disposed in the jet plates 8. Food product placed on any one of the racks (or simply on a base of the cooking chamber 2 in embodiments where multiple racks are not employed) may be heated at least partially using radio frequency (RF) energy. Moreover, in some cases, the rack 9 (or racks) may be example embodiments of an energy conversion assembly. Similarly, an oven bottom 11 (e.g., a floor or bottom surface of the cooking chamber 2) may be provided as an example of the energy conversion assembly.

In an example embodiment, if forced air is employed, air may be drawn out of the cooking chamber 2 via a chamber outlet port 10 disposed at a rear wall (i.e., a wall opposite the door 4) of the cooking chamber 2. Air may be circulated from the chamber outlet port 10 back into the cooking chamber 2 via the air delivery orifices in the jet plates 8. After removal from the cooking chamber 2 via the chamber outlet port 10, air may be cleaned, heated, and pushed through the system by other components prior to return of the clean, hot and speed controlled air back into the cooking chamber 2. Of note, some embodiments may not employ forced air flow, and thus, the chamber outlet port 10 and the jet plates 8 may either be eliminated, or unused. They could also be arranged differently in some embodiments where they are used.

Figure 2:
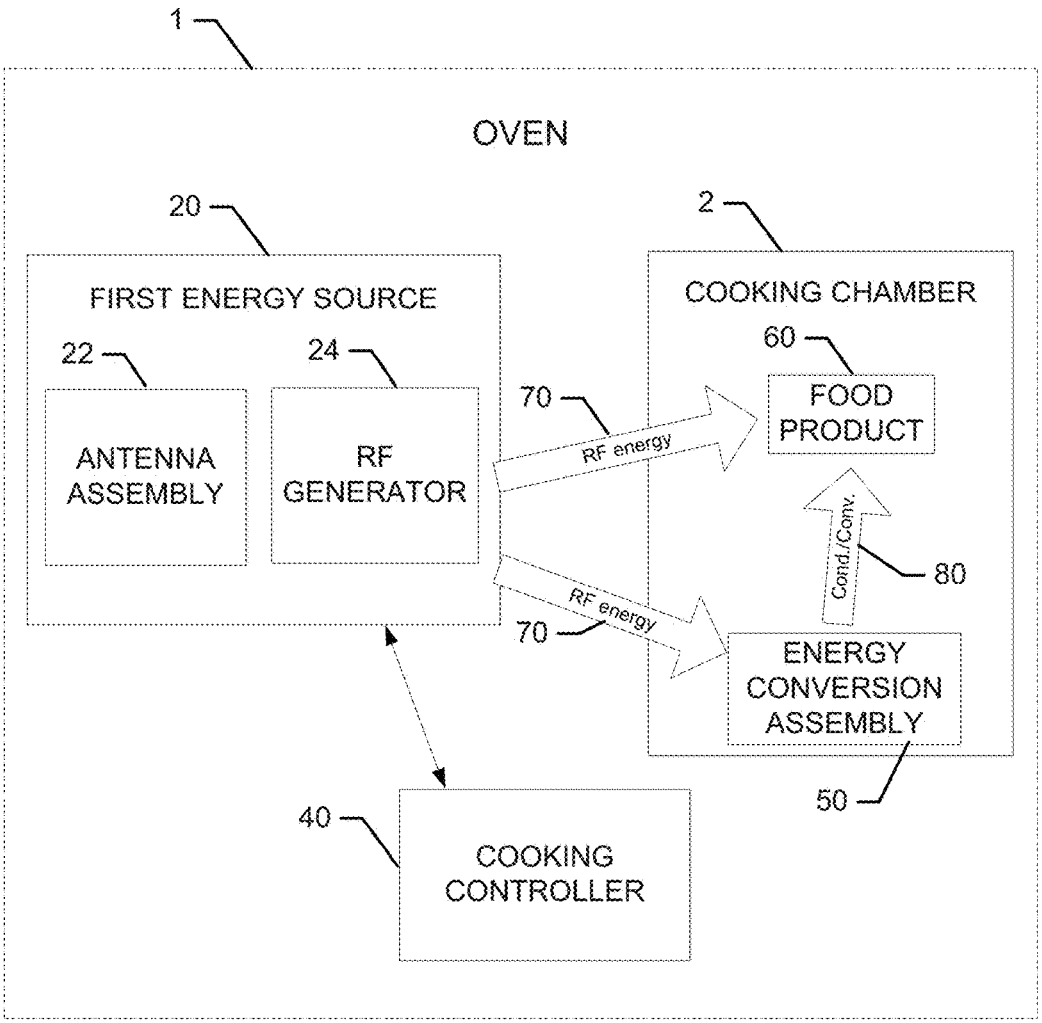
FIG. 2 illustrates a functional block diagram of the oven of FIG. 1 according to an example embodiment.

As indicated above, some example embodiments may employ a single energy source to provide two different heat application methods. FIG. 2 illustrates a functional block diagram of the oven 1 according to an example embodiment. As shown in FIG. 2, the oven 1 may include at least a first energy source 20. Although not required (and absent from some embodiments), it is also possible that a second energy source could be included. If employed, the second energy source may be, for example, a convective heating source. However, since the second energy source is not required, the example of FIG. 2 will be described in reference only to the first energy source 20. The first energy source 20 of an example embodiment may be an RF heating source.

In an example embodiment, the first energy source 20 may be a radio frequency (RF) energy source (or RF heating source) configured to generate relatively broad spectrum RF energy or a specific narrow band, phase controlled energy source to cook food product placed in the cooking chamber 2 of the oven 1. Thus, for example, the first energy source 20 may include an antenna assembly 22 and an RF generator 24. The RF generator 24 of one example embodiment may be configured to generate RF energy at selected levels over a range of about 800 MHz to 1 GHz. However, other RF energy bands may be employed in some cases. The antenna assembly 22 may be configured to transmit the RF energy into the cooking chamber 2. In some cases, the antenna assembly 22 may further be configured to receive feedback to indicate absorption levels of respective different frequencies in the food product. The absorption levels may then be used to control the generation of RF energy to provide balanced cooking of the food product. In some embodiments, the antenna assembly 22 may include multiple antennas. Thus, for example, four antennas may be provided and, in some cases, each antenna may be powered by its own respective power module of the RF generator 24 operating under the control of a cooking controller 40. In an alternative embodiment, a single multiplexed generator may be employed to deliver different energy into each compartment of the cooking chamber 2.

In an example embodiment, the feedback driven responsiveness of the first energy source 20 may provide for a relatively high degree of uniformity in the cooking achieved. For example, if some frequencies generated by the RF generator 24 are being absorbed more or less in certain regions, the feedback provided to the RF generator 24 may enable more even application of desired frequencies to give a more uniform RF absorption profile within the cooking chamber 2.

In some example embodiments, the first energy source 20 may be controlled, either directly or indirectly, by the cooking controller 40. The cooking controller 40 may be configured to receive inputs descriptive of the food product and/or cooking conditions (e.g., via the interface panel 6) in order to provide instructions or controls to the first and second energy sources 20 and 30 to control the cooking process. In some embodiments, the cooking controller 40 may be configured to receive static and/or dynamic inputs regarding the food product and/or cooking conditions. Dynamic inputs may include feedback data regarding absorption of RF spectrum, as described above. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), and/or the like.

In an example embodiment, the cooking controller 40 may be configured to access data tables that define RF cooking parameters used to drive the RF generator 24 to generate RF energy at corresponding levels and/or frequencies for corresponding times determined by the data tables based on initial condition information descriptive of the food product and/or based on feedback indicative of RF absorption. As such, the cooking controller 40 may be configured to employ RF cooking as a primary energy source for cooking the food product. However, other energy sources (e.g., secondary and tertiary or other energy sources) may also be employed in the cooking process.

In some cases, cooking signatures, programs or recipes may be provided to define the cooking parameters to be employed for each of multiple potential cooking stages that may be defined for the food product and the cooking controller 40 may be configured to access and/or execute the cooking signatures, programs or recipes. In some embodiments, the cooking controller 40 may be configured to determine which program to execute based on inputs provided by the user except to the extent that dynamic inputs (i.e., changes to cooking parameters while a program is already being executed) are provided. In an example embodiment, an input to the cooking controller 40 may also include browning instructions. In this regard, for example, the browning instructions may include instructions regarding the air speed, air temperature and/or time of application of a set air speed and temperature combination (e.g., start and stop times for certain speed and heating combinations) if airflow is employed. The browning instructions may be provided via a user interface accessible to the operator, or may be part of the cooking signatures, programs or recipes. Moreover, in some cases, the browning instructions may indicate a particular zone in which to place a particular item to be cooked.

As mentioned above, different cooking zones can be defined based on the inclusion of an energy conversion assembly 50 within the cooking chamber 2. The energy conversion assembly 50 may be configured to allow the first energy source 20 to be employed to cook a food product 60 via at least two methods. For example RF energy 70 may directly be applied to the food product 60 (e.g., in the manner described above) by the cooking controller 40. However, RF energy 70 may also be applied to the energy conversion assembly 50 to convert the RF energy 70 into conductive/convective heat energy 80. Thus, the food product 60 is cooked using both the conductive/convective heat energy 80 and the RF energy 70. However, the RF generator 24 is ultimately responsible for generation of both of these heating sources.

The energy conversion assembly 50 may be made, at least in part, by employing a thermally conductive base matrix that can be fortified with a silica ferrite particulate (or other finely ground ferromagnetic granules). The thermally conductive properties of the base matrix may be conducive to dispersion of thermal energy across a surface of the energy conversion assembly 50. When the energy conversion assembly 50 is exposed to the RF energy 70, the ferromagnetic particulate material may absorb the RF energy 70 and transform the RF energy 70 into thermal energy that can be transferred to the food product 60 as conductive or convective heat energy 80.

In an example embodiment, the base matrix (or carrier matrix) may be ceramic, silicon, plastic or any other suitable material. The ferromagnetic particulate material may then be mixed into the base matrix in any desirable concentration and formed into a plate-like structure that is suitable for forming a cooking surface in the oven 1. Binders and/or filler materials may be provided in some cases. The resulting structure forming the energy conversion assembly 50 may therefore be embodied as a rigid (an in some cases entirely flat over the majority of or its entire surface) component suitable for supporting one or a plurality of instances of the food product 60. The energy conversion assembly 50 could have portions thereof that are formed in a manner similar to that described in EP14179718.3, the contents of which are incorporated herein in their entirety.

The amount of RF energy 70 (including microwave energy or any other frequencies suitable for RF cooking) that is absorbed by the energy conversion assembly 50 may be determined by 1) the relative quantity of ferromagnetic particulate material that is provided in the base matrix, and 2) the regional concentration of the ferromagnetic particulate material throughout the base matrix. Accordingly, by altering the concentration of ferromagnetic particulate material in different regions or zones of the energy conversion assembly 50, corresponding different heat transformation rates and/or properties may be achieved. As such, for example, if the entirety of the energy conversion assembly 50 has the same concentration of the ferromagnetic particulate material throughout the base matrix, then the rate of conversion of RF energy 70 into thermal energy (e.g., conductive/convective energy 80) may be uniform over the entire surface of the energy conversion assembly 50. However, by creating regions of the energy conversion assembly 50 that have different concentrations of the ferromagnetic particulate material in the base matrix, corresponding different regions with different heat transformation properties may be provided.

Accordingly, in an example embodiment, the energy conversion assembly 50 may be fabricated to have any desirable properties or configuration relative to the provision of regions that can be considered to be separate heat zones. In this regard, during fabrication, the base matrix can be provided with specific regions having corresponding specific desirable shapes that can be provided with different concentrations of the ferromagnetic particulate material to create custom designed heat zones. Regions having higher concentrations of the ferromagnetic particulate material will transform RF energy 70 into thermal energy (e.g., conductive/convective energy 80) at a greater rate than regions having lower concentrations of the ferromagnetic particulate material. Thus, the regions having higher concentrations may be considered to be hotter zones than the regions having the lower concentrations.

In an example embodiment, the RF energy 70 applied may be applied at a single selected frequency that is useful both for cooking the food product 60, and for heating the energy conversion assembly 50. However, in other examples, a different frequency may be used to heat the food product 60 than the frequency used to heat the energy conversion assembly 50. Thus, for example, two frequencies could be applied by the RF generator 24 and the first frequency may be selected to be absorbed more readily by the food product 60 while the second frequency may be selected to be absorbed more readily by the energy conversion assembly 50.

As mentioned above, the energy conversion assembly 50 could be a fixed surface or removable surface within the oven 1. Thus, for example, the energy conversion assembly 50 could be embodied as a removable oven rack. Accordingly, a plurality of different energy conversion assemblies, each having corresponding different characteristics may be provided for use in the oven 1 either individually or simultaneously. For example, one energy conversion assembly 50 could be provided as a first rack in the oven 1 to provide one or more different heat zones (which may have custom shapes and/or sizes) so that different food items can be placed in the corresponding different heat zones to have different levels of thermal energy applied thereto. One or more other energy conversion assemblies may then be placed on different racks (or the bottom of the oven) to provide options for different heat zones that apply heat faster or slower, or to service food or containers having different shapes.

In some cases, the food items may be directly placed on the different heat zones. However, in other embodiments, the food items may be completely or partially wrapped, supported or packaged in/by a conductive material (e.g., aluminum, copper, cast iron, iPinium, and/or the like). Areas of the food items that are in contact with the conductive material may therefore be susceptible to increased conductive/convective heating by the thermal energy converted by the energy conversion assembly 50 to alter cooking characteristics (e.g., increase heat application speed and/or provide browning).

Figure 3:
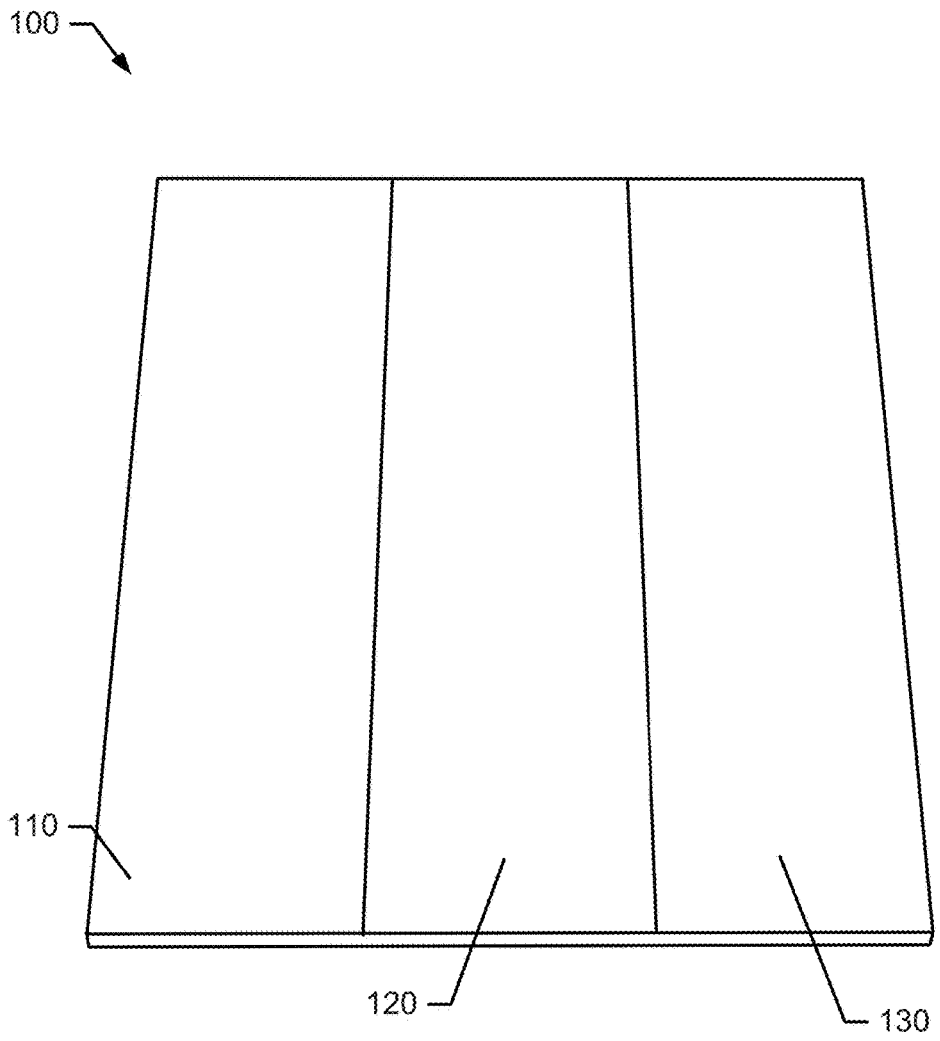
FIG. 3 illustrates a perspective view of an energy conversion assembly according to an example embodiment.

FIG. 3 illustrates a perspective view of one example embodiment of an energy conversion assembly 100 that may include multiple heat zones. In the example of FIG. 3, the energy conversion assembly 100 includes a first heat zone 110, a second heat zone 120 and a third heat zone 130. The first heat zone 110 may have a first concentration of ferromagnetic particulate material, the second heat zone 120 may have a second concentration of ferromagnetic particulate material, and the third heat zone 130 may have a third concentration of ferromagnetic particulate material. The first, second and third concentrations may each be different from each other. For example, the first concentration may be higher than the second concentration, which may be higher than the third concentration. In the example of FIG. 3, an overall heat gradient may be created from left to right (or front to back) across the energy conversion assembly 100.

Figure 4:
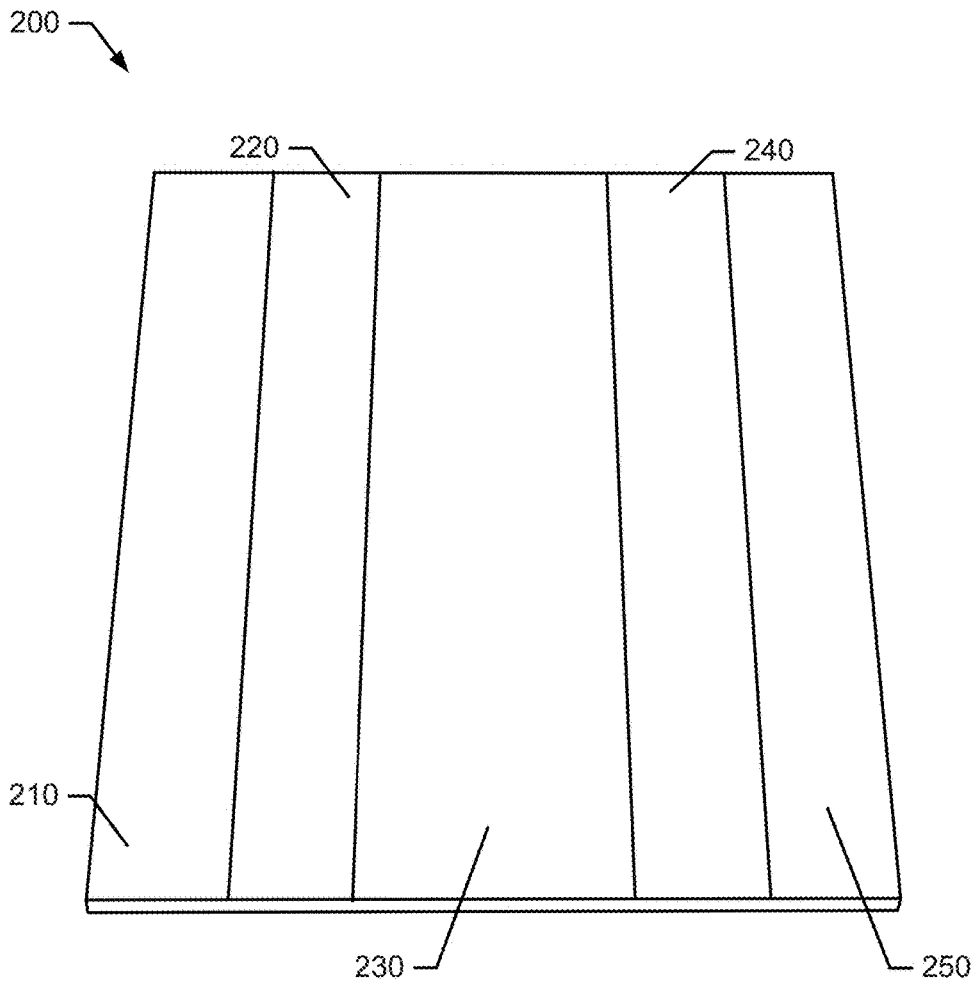
FIG. 4 illustrates a perspective view of an alternative design for an energy conversion assembly according to an example embodiment.

In the example of FIG. 3, the sizes and shapes of the first, second and third heat zones 110, 120 and 130 are each similar (e.g., rectangular shapes of substantially the same size). However, it should be appreciated that the sizes and shapes could be different as well. FIG. 4 illustrates an example of an energy conversion assembly 200 that may include multiple heat zones that can have different sizes. In the example of FIG. 4, the energy conversion assembly 200 includes a first heat zone 210, a second heat zone 220, a third heat zone 230, a fourth heat zone 240 and a fifth heat zone 250. Each of the heat zones may have a different concentration. However, in this example, the first and fifth heat zones 210 and 250 may have the same concentration (e.g., a first concentration) and the second and fourth heat zones 220 and 240 may have the same concentration (e.g., a second concentration), and the third heat zone 230 may have a third concentration. Again, the first, second and third concentrations may each be different from each other. For example, the third concentration may be higher than the second concentration, which may be higher than the first concentration. In the example of FIG. 4, the hottest portions or zones may be centrally located. However, this pattern could be reversed. In this example, although the sizes of the heat zones are not all the same, the areas of heat zones having the same concentration may be equal.

Figure 5:
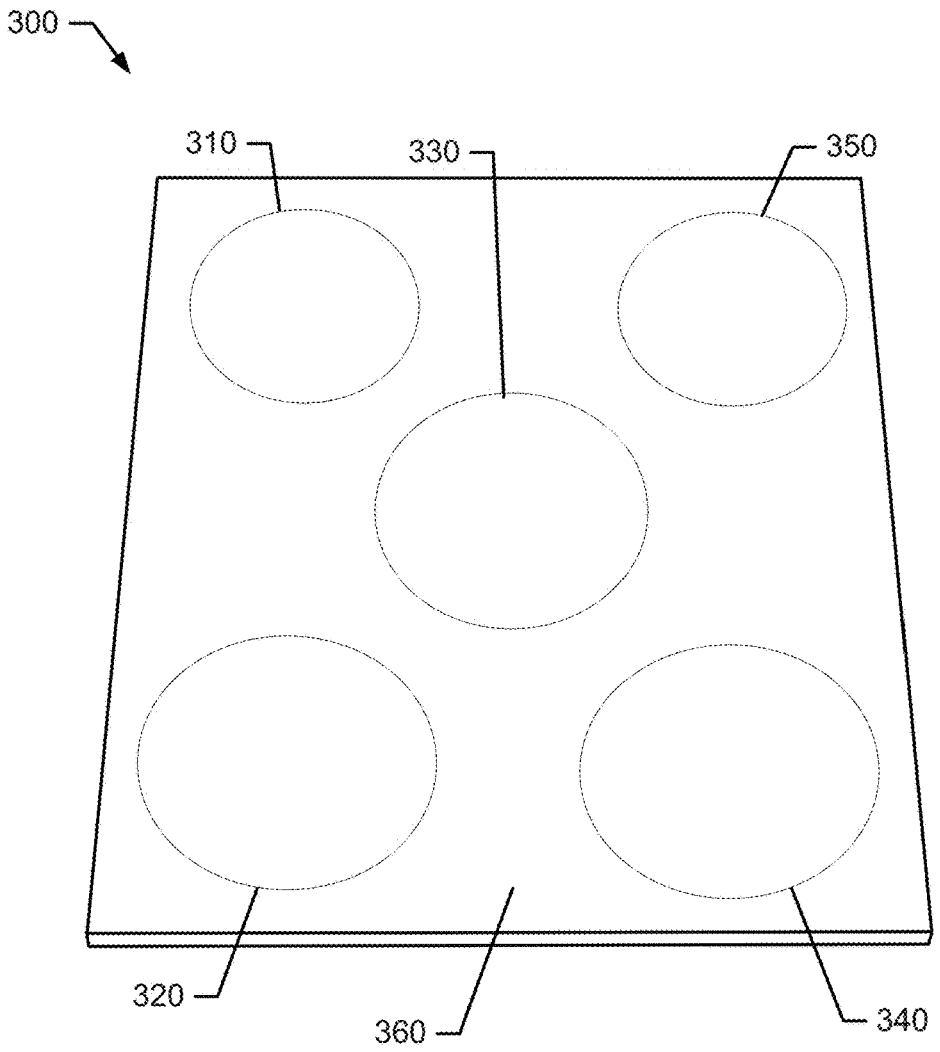
FIG. 5 illustrates a perspective view of another alternative design for an energy conversion assembly according to an example embodiment.

FIG. 5 illustrates an example embodiment with different shaped heat zones. In the example of FIG. 5, the energy conversion assembly 300 includes a first heat zone 310, a second heat zone 320, a third heat zone 330, a fourth heat zone 340 and a fifth heat zone 350. The heat zones of FIG. 5 are each circular in shape, and each of the heat zones may have a different concentration. However, in this example, the first and fifth heat zones 310 and 350 may have the same concentration (e.g., a first concentration) and the second and fourth heat zones 320 and 340 may have the same concentration (e.g., a second concentration), and the third heat zone 230 may have a third concentration. Again, the first, second and third concentrations may each be different from each other. For example, the third concentration may be higher than the second concentration, which may be higher than the first concentration. The sizes of each of the heat zones may be the same, or different. In an example embodiment, sizes of each of the heat zones may decrease as distance from one side (e.g., the front) of the energy conversion assembly 300 increases. In some embodiments, the area outside the first, second, third, fourth and fifth heat zones 310, 320, 330, 340 and 350 may define a separate heat zone (e.g., a sixth heat zone 360) having a different concentration, or may not have any ferromagnetic particulate. material therein.

Figure 6:
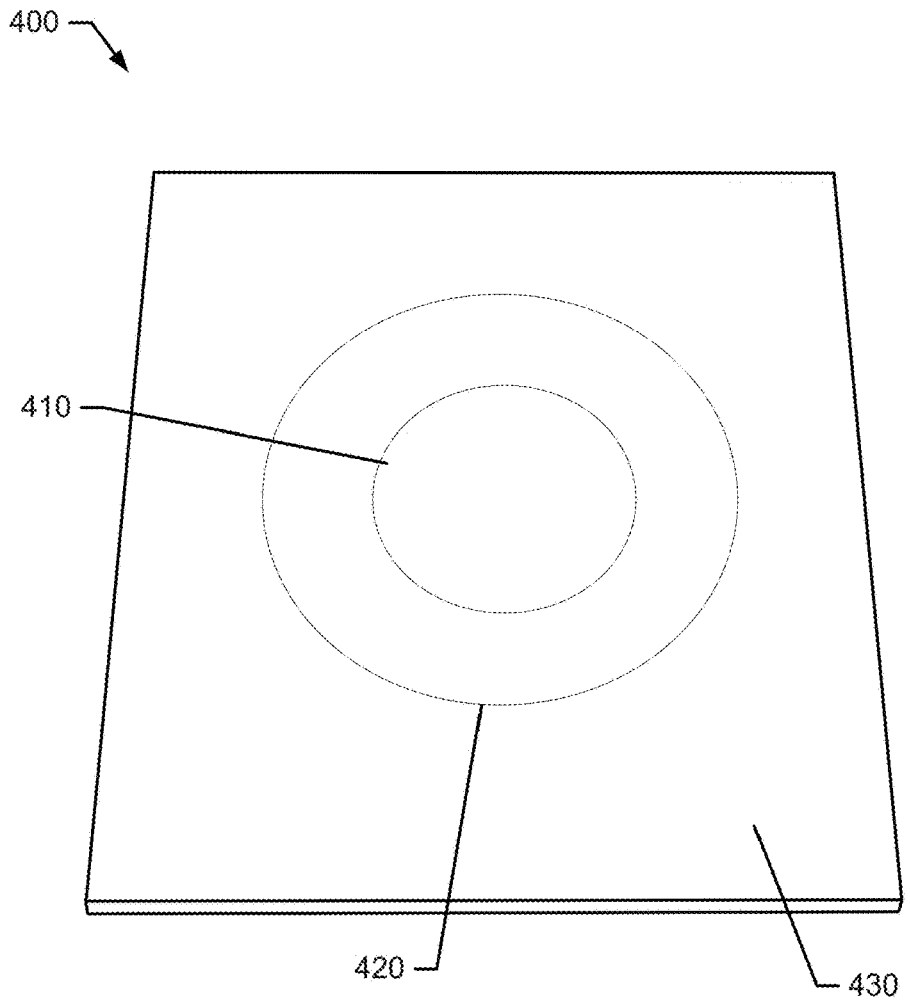
FIG. 6 illustrates a perspective view of yet another alternative design for an energy conversion assembly according to an example embodiment.

In some cases, rather than dispersing the different heat zones in different regions or areas that are separated from each other (as shown in FIG. 5), the heat zones could be concentric. FIG. 6 illustrates an example of an energy conversion assembly 400 that includes a first heat zone 410, a second heat zone 420 and a third heat zone 430 that are arranged to be concentric with each other. The first heat zone 410 may have a first concentration of ferromagnetic particulate material, the second heat zone 420 may have a second concentration of ferromagnetic particulate material, and the third heat zone 430 may have a third concentration of ferromagnetic particulate material. The first, second and third concentrations may each be different from each other. For example, the first concentration may be higher than the second concentration, which may be higher than the third concentration. In the example of FIG. 3, an overall heat gradient may be created that decreases as distance from the center of the energy conversion assembly 400 increases. The outer shapes of the first and second heat zones 410 and 420 may be circular and have increasing respective diameters. However, the first heat zone 410 is concentric with the second heat zone 420, the second heat zone 420. Meanwhile, the third heat zone 430 may extend around all portions of the second heat zone 430 and have a different shape (e.g., rectangular).

Figure 7:
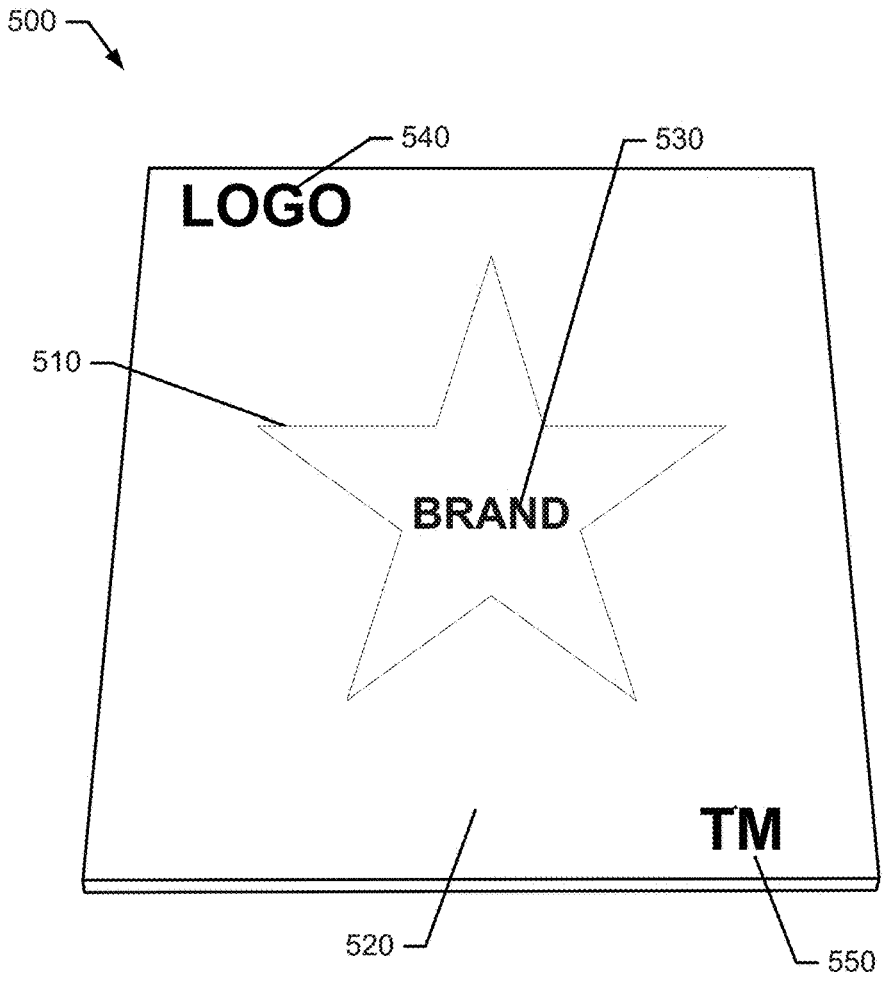
FIG. 7 illustrates a perspective view of still another alternative design for an energy conversion assembly according to an example embodiment.

The heat zones can also have more custom shapes, or even shapes that include brands or logos. FIG. 7 illustrates an example in which an energy conversion assembly 500 that includes a first heat zone 510 and a second heat zone 520 with different concentrations is provided. In the example of FIG. 7, branding information 530, a logo 540 and/or a trademark 550 may be provided in either or both of the heat zones. The branding information 530, logo 540 and/or trademark 550 could have the same concentrations as their surrounding areas and therefore just be cosmetic enhancements. However, in other examples, the branding information 530, logo 540 and/or trademark 550 could have different concentrations from their surrounding areas and therefore be functional enhancements in addition to providing cosmetic differences.

In some embodiments, the energy conversion assembly 50 (or any of the examples of FIGS. 3-7) may be heated during the process of cooking using RF energy 70 from an initially cooled, ambient, or otherwise random initial state. However, in other embodiments, a predetermined amount of RF energy 70 may be applied to heat up the energy conversion assembly 50 prior to placing food in one or more heating zones. As such, for example, a given preheat time may be prescribed for the energy conversion assembly 50 to ensure that the heating zones defined therein are heated to a known or desired initial temperature. The preheat time may be the same for any instance of the energy conversion assembly 50, or the preheat time may be specifically defined for each respective instance of the energy conversion assembly 50 based on the respective initial temperatures that are achievable or desirable for the energy conversion assembly 50. For high power preheating, the preheat time may be relatively short.

Figure 8:
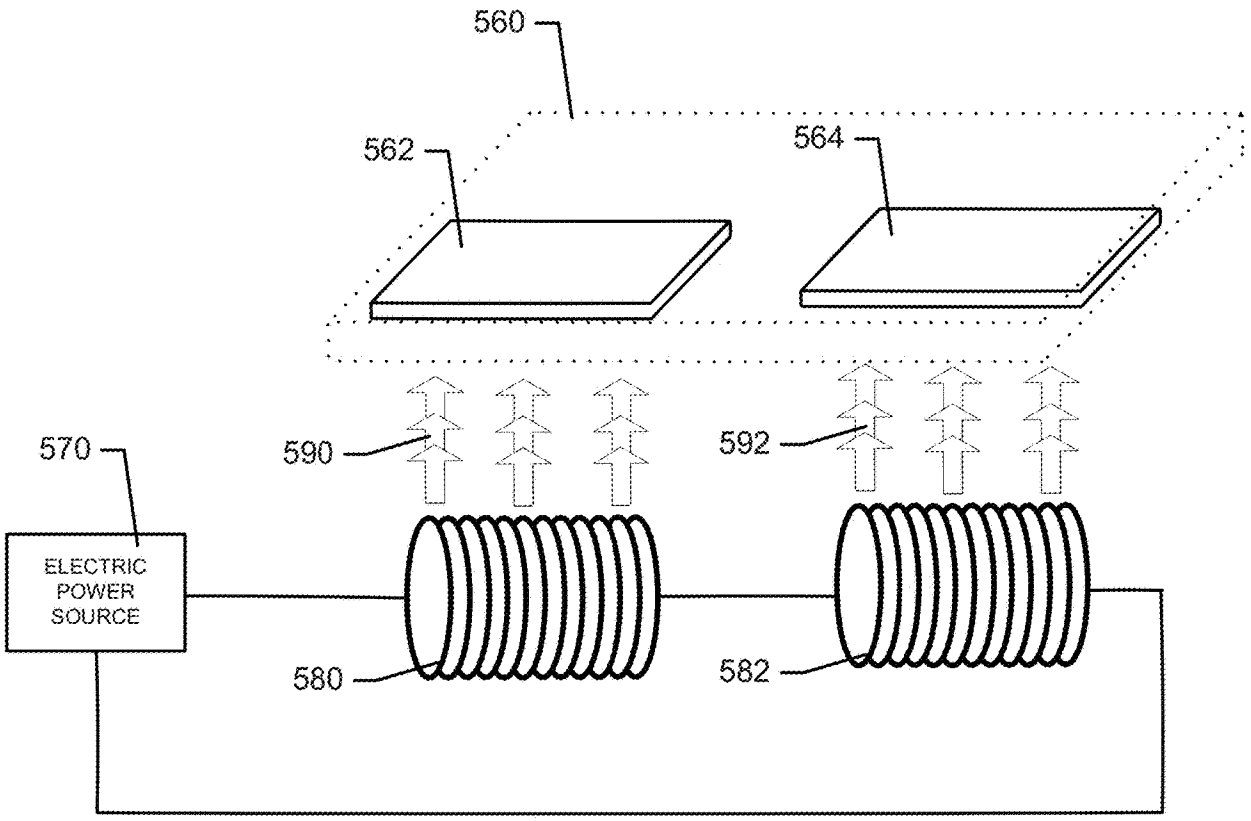
FIG. 8 illustrates a perspective view of an alternative design for an energy conversion assembly that employs an induction heat sources in accordance with an example embodiment.

In the examples described above, an RF heat source is used to generate different heat application zones based on corresponding different concentrations ferromagnetic particulate material. However, a different heat source could be employed in some example embodiments. For example, electricity may be used to provide power to one or more induction coils that may in turn induce an electrical current in the varying regional concentrations of ferromagnetic particulate within the energy conversion assembly in a manner that allows variable heat zones on the basis of the ferromagnetic particulate material concentration. FIG. 8 illustrates an example embodiment of an energy conversion assembly 560 that may include one or a plurality of heat zones that may employ induction heating. In the example of FIG. 8, the energy conversion assembly 560 includes a first heat zone 562 and a second heat zone 564 that each have a respective (same or different) concentration of ferromagnetic particulate material. An electric power source 570 is provided to energize a first induction coil 580 and a second induction coil 582 with alternating current (AC). Of note, the first and second induction coils 580 and 582 may each represent a single coil or multiple coils. Moreover, it should be appreciated that respective different sources could power respective different coils, or a single source could power multiple coils. When AC is provided to the first and second induction coils 580 and 582, the coils may generate corresponding first and second magnetic fields 590 and 592. The first and second magnetic fields 590 and 592 may vary or oscillate based on the changes in the AC to generate a changing magnetic field. The oscillating magnetic field may induce currents in the ferromagnetic particulate with each of the first heat zone 562 and the second heat zone 564. These currents may generate heat that has a magnitude that depends upon (e.g., is proportional to) the concentration of the ferromagnetic particulate material in each of the heat zones. In some cases, the magnetic fields may pass through a transparent support surface (e.g., glass, ceramic or plastic) prior to reaching the first and second heat zones 562 and 564 of the energy conversion assembly 560. The heat zones of FIG. 8 are each rectangular in shape, but could have any shape. In any case, however, each of the heat zones may have a different concentration of ferromagnetic particular material and may therefore have different rates of energy conversion to provide different heat zones, as described above. In this example, the different concentrations in respective ones of the heat zones may cause different heat conversion rates and therefore different heat application characteristics for the respective different heat zones based on ferromagnetic particulate concentration. The electric power source 570 may be employed in addition to, or instead of the RF heat source.

An oven of an example embodiment may therefore employ an energy conversion assembly that is configured to be able to generate multiple heat zones that have different heat application properties, but are powered from a single source. The energy conversion assembly may also or alternatively be configured to use one heat energy source to generate heat for cooking by two different methods. Additionally or alternatively, the energy conversion assembly may be configured to use multiple frequencies and one such frequency may be used to directly heat a food item placed on the energy conversion assembly, and the other frequency may be used to indirectly heat the food item placed on the energy conversion assembly based on converting the energy associated with the second frequency into thermal energy to be conductively or convectively applied to the food item.

Figure 9:
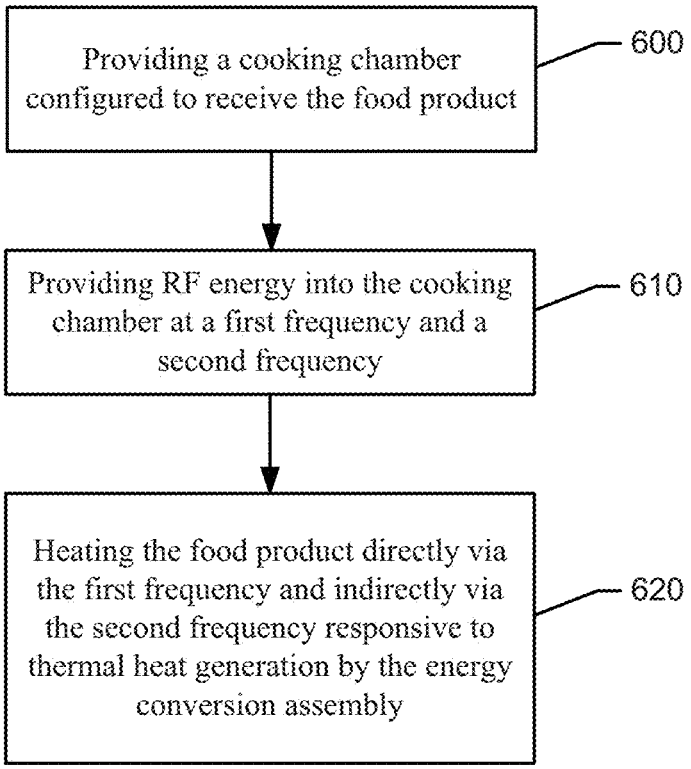
FIG. 9 illustrates a block diagram of a method of cooking in accordance with an example embodiment.

FIG. 9 illustrates a block diagram of a method of cooking a food product in an oven having a surface therein that includes an energy conversion assembly in accordance with an example embodiment. As shown in FIG. 9, the method may include providing a cooking chamber configured to receive the food product at operation 600, providing RF energy into the cooking chamber at a first frequency and a second frequency at operation 610, and heating the food product directly via the first frequency and indirectly via the second frequency responsive to thermal heat generation by the energy conversion assembly at operation 620. The energy conversion assembly may include a base matrix and ferromagnetic particulate material dispersed in the base matrix. The ferromagnetic particulate material may absorb RF energy to transform the RF energy into thermal energy.

In some cases, the method may include various modifications, additions or augmentations that may optionally be applied. Thus, for example, in some cases, heating the food product indirectly may include heating the food product indirectly at a different rate based on a corresponding heat zone of the oven at which the food product is placed. In some cases, the energy conversion assembly may include a first heat zone having a first concentration of the ferromagnetic particulate material therein, and a second heat zone having a second concentration of the ferromagnetic particulate material therein. The first and second concentrations may be different from each other. In some embodiments, the energy conversion assembly may be preheated prior to the food product being received in the cooking chamber.

Example embodiments define heat zones based on the amount and placement of ferromagnetic particulate material within a base matrix during the manufacture of the energy conversion assembly. Accordingly, different food products can be simultaneously cooked, but may receive different amounts of thermal energy within the same cooking chamber that is being supplied with RF energy as the source of the thermal energy. The RF energy application may be cycled or continuously maintained to create the thermal heat (and/or to cook the food product directly). As a result, a highly versatile and customizable cooking arrangement may be provided.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

a cooking chamber configured to receive a food product;

a radio frequency (RF) heating system configured to provide RF energy into the cooking chamber; and an energy conversion assembly provided as a cooking surface of the oven, the energy conversion assembly being configured to convert at least some of the RF energy into thermal energy for heating the food product, while at least some other portion of the RF energy is directly applied to the food product to heat the food product, wherein the energy conversion assembly comprising a base matrix formed substantially to have a plate shape and ferromagnetic particulate material dispersed in the base matrix, wherein the ferromagnetic particulate material absorbs RF energy to transform the RF energy into thermal energy, and wherein the energy conversion assembly comprises a first heat zone forming a first flat surface at a first portion of the energy conversion assembly and having a first concentration of the ferromagnetic particulate material therein, and a second heat zone forming a second flat surface at a second portion of the energy conversion assembly and having a second concentration of the ferromagnetic particulate material therein, the first and second concentrations being different from each other.

2. The oven of claim 1, wherein the first and second heat zones are substantially equal in size and shape.

3. The oven of claim 1, wherein the first and second heat zones are substantially different in size or shape.

4. The oven of claim 1, wherein the energy conversion assembly is configured to absorb RF energy corresponding to a first frequency, and wherein the RF energy directly applied to the food product is applied at a second frequency that is different than the first frequency.

5. The oven of claim 1, wherein the energy conversion assembly is provided as a removable rack in the oven.

6. The oven of claim 1, wherein the energy conversion assembly defines a gradient of thermal heat application capacity along a direction moving across the flat surface of the energy conversion assembly.

7. A method of cooking a food product in an oven having a flat surface therein comprising an energy conversion assembly, the method comprising:

providing a cooking chamber configured to receive the food product;

providing radio frequency (RF) energy into the cooking chamber at a first frequency and a second frequency; and heating the food product directly via the first frequency and indirectly via the second frequency responsive to thermal heat generation by the energy conversion assembly, the energy conversion assembly comprising a base matrix and ferromagnetic particulate material dispersed in the base matrix, the ferromagnetic particulate material absorbing RF energy to transform the RF energy into thermal energy.

8. The oven of claim 1, wherein the energy conversion assembly comprises one of a plurality of different energy conversion assembly arrangements that are removable from and insertable into the oven, at least one of the different energy conversion assembly arrangements having branding information, logo information or trademark symbols provided therein.

9. An energy conversion assembly for use in an oven, the energy conversion assembly comprising:

a base matrix comprising formed substantially to have a plate shape; and ferromagnetic particulate material dispersed in the base matrix, the ferromagnetic particulate material absorbing radio frequency (RF) energy applied to the base matrix to transform the RF energy into thermal energy, wherein a concentration of the ferromagnetic particulate material is changed in corresponding different locations to define at least a first heat zone forming a first flat surface at a first portion of the energy conversion assembly and having a first concentration of the ferromagnetic particulate material therein, and a second heat zone forming a second flat surface at a second portion of the energy conversion assembly and having a second concentration of the ferromagnetic particulate material therein, the first and second concentrations being different from each other.

10. The oven of claim 1, wherein oven further comprises an induction coil disposed proximate to the at least one of the first and second heat zones to apply a changing magnetic field to the at least one of the first and second heat zones responsive to energizing the induction coil.

11. The energy conversion assembly of claim 9, wherein the first and second heat zones are substantially different in size or shape.

12. The energy conversion assembly of claim 9, wherein the energy conversion assembly is configured to absorb RF energy corresponding to a first frequency, and wherein RF energy corresponding to a second frequency is directly applied to the food product to heat the food product, and wherein the second frequency is different than the first frequency.

13. The energy conversion assembly of claim 9, wherein the energy conversion assembly is provided as a removable rack in the oven.

14. The energy conversion assembly of claim 9, wherein the energy conversion assembly defines a gradient of thermal heat application capacity along a direction moving across a surface of the energy conversion assembly.

15. The method of claim 7, further comprising preheating the energy conversion assembly by applying RF energy to be absorbed by the energy conversion assembly prior to placement of the food product in the cooking chamber.

16. The method of claim 7, wherein heating the food product indirectly comprises heating the food product indirectly at a different rate based on a corresponding heat zone of the oven at which the food product is placed.

17. The method of claim 16, wherein the energy conversion assembly comprises a first heat zone having a first concentration of the ferromagnetic particulate material therein, and a second heat zone having a second concentration of the ferromagnetic particulate material therein, the first and second concentrations being different from each other.

18. The method of claim 7, further comprising preheating the energy conversion assembly prior to the food product being received in the cooking chamber.

19. The oven of claim 1, wherein the first heat zone and second heat zone are in contact with each other along lateral edges of the first and second heat zones.

20. The energy conversion assembly of claim 9, wherein the first heat zone and second heat zone are in contact with each other along lateral edges of the first and second heat zones.

* * * * *